US012583080B2

(12) United States Patent
McIntyre

(10) Patent No.: US 12,583,080 B2
(45) Date of Patent: Mar. 24, 2026

(54) WET AND DRY ABRASIVE MEDIA BLASTING SYSTEM

(71) Applicant: 2623223 Ontario Inc., Dunnville (CA)

(72) Inventor: John Walter McIntyre, Port Colborne (CA)

( * ) Notice: Subject to any disclaimer, the term of this patent is extended or adjusted under 35 U.S.C. 154(b) by 513 days.

(21) Appl. No.: 18/084,862

(22) Filed: Dec. 20, 2022

(65) Prior Publication Data

US 2024/0198487 A1 Jun. 20, 2024

(51) Int. Cl.
*B24C 7/00* (2006.01)
*B24C 3/04* (2006.01)

(52) U.S. Cl.
CPC ..... *B24C 7/0061* (2013.01); *B24C 3/04* (2013.01)

(58) Field of Classification Search
CPC ... B24C 7/0053; B24C 7/0084; B24C 7/0046; B24C 7/0061; B24C 7/0038; B24C 7/00; B24C 7/007
See application file for complete search history.

(56) References Cited

U.S. PATENT DOCUMENTS 1,585,549 A * 5/1926 Jorgensen ..... B24C 7/0046 451/100
2,388,818 A * 11/1945 Bick ..... B24C 7/0053 451/99
2,569,952 A * 10/1951 Ridley ..... E04F 21/12 451/100
2,938,305 A * 5/1960 Bipes ..... B24C 7/0046 451/99
4,048,757 A * 9/1977 Kubus ..... B24C 3/327 451/99
5,083,402 A * 1/1992 Kirschner ..... B24C 7/0084 451/39
5,097,633 A * 3/1992 Branton ..... B24C 7/0053 451/99
5,207,034 A * 5/1993 Lynn ..... B24C 7/0061 451/99
5,283,991 A * 2/1994 Keizers ..... B24C 11/00 451/99
5,407,379 A * 4/1995 Shank ..... B24C 7/0069 451/99

(Continued)

*Primary Examiner* — Joel D Crandall

(57) ABSTRACT

A wet and dry abrasive media blasting system comprises a compressed air supply providing a supply of blast air and pot air. The blast air is communicated along a blast air supply line and pot air is communicated along a pot air supply line. A blast pot is configured to receive abrasive media and pot air and release abrasive media at a discharge and into a media conduit which communicated abrasive media to a mixing device. An air pressure amplifier disposed on the pot air supply line is adapted to selectively increase the air pressure of a pot air head creating an over-pressure, such that the over-pressure which is pressure of pot air head less the pressure of the blast air is positive. The blast air and the abrasive media are mixed together in the mixing device to form a blast air media mixture which is communicated to a nozzle and discharged from the nozzle as a blast spray. The system further includes a metering valve disposed on the media conduit, downstream of the discharge, and up stream of the mixing device, the metering valve selectively controls the flow and therefore the amount of abrasive media communicated to the mixing device.

18 Claims, 3 Drawing Sheets

(56) References Cited

U.S. PATENT DOCUMENTS

| | | | | |
|---|---|---|---|---|
| 7,549,911 | B2 * | 6/2009 | Nguyen | F16K 39/022 451/99 |
| 9,388,330 | B2 * | 7/2016 | Sugimoto | B24C 11/005 |
| 2012/0015592 | A1 * | 1/2012 | Eliason | B24C 7/0015 451/91 |
| 2015/0105001 | A1 * | 4/2015 | Eliason | B24C 7/0053 451/101 |
| 2018/0021923 | A1 * | 1/2018 | McIntyre | B24C 7/0023 451/94 |

* cited by examiner 302
304
305
306
308
310
312
314
316
318
320
321
322
323
324
325
326
328
330
332
336
338
340
342
343
344
346
300

WET AND DRY ABRASIVE MEDIA BLASTING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to abrasive media blasting and more particularly relates to systems capable of both wet and dry abrasive media blasting. (B24C)

SUMMARY OF THE PRIOR ART

Traditional dry abrasive media blasting uses an abrasive media such as sand and compressed air to propel the abrasive media at high velocity at a desired surface. Typically the dry media is housed in a cylindrical blast pot with a lower conical end. The abrasive media flows downwardly under gravity out of an orifice in the bottom of the pot. The amount of abrasive flow is controlled with a metering valve at the bottom of the blast pot. The abrasive media is inserted into a stream of compressed air creating a mixture of compressed air with entrained abrasive media. These type of systems typically are limited to an abrasive media size of no smaller than 40-80 mesh beyond which clumping and non-uniform flow of abrasive media is observed in the blast pot which results in an uncontrollable flow of abrasive media.

Traditional wet abrasive media blasting uses an abrasive media such as sand which is mixed with water to create a slurry which is loaded into a similar blast pot as with the dry blasting described above. The blast pot is bled of all air since entrapped compressible air in the blast pot causes well known uncontrollable and unwanted pressure fluctuations that effect the consistency and safety of the blasting operation. This problem is described in U.S. Pat. No. 8,986,074 titled Fluid Control Circuit for Wet Abrasive Blasting by inventor Keith Eliason. The water abrasive slurry is inserted into a stream of compressed air creating a mixture of compressed air with entrained abrasive media and water. The slurry expended in the blast pot is replaced with water which is pumped into the blast pot under a controlled pressure which in turn controls the amount of slurry inserted into the air stream.

A Wet and Dry Abrasive Media Blasting System is described in U.S. Pat. No. 11,484,988 titled Dry Wet Blast Media Blasting System by inventor Phuong Taylor Nguyen. The system described by Nguyen is a dry blast system wherein water is injected downstream but in close proximity to the abrasive/air mixing device. In particular See FIGS. 1 and 6 of the patent for a depiction of the system. Control of the uniformity of the mixing of the air, water and abrasive is problematic with the type of wet/dry system described in the Nguyen patent. Nguyen describes his system as an attempt to provide a blast process which provides more uniform distribution of the water, air and media components. Unfortunately the inventor of the present application has found that in practice the Nguyen system is difficult to control and uses excessive amounts of consumables to produce a desired result.

SUMMARY OF INVENTION

The present wet and dry abrasive media blasting system simplifies the equipment required and improves the performance of the blasting process for both wet abrasive media blasting and dry abrasive media blasting in a single multi-purpose blasting unit.

The present concept is a wet and dry abrasive media blasting system which includes a compressed air supply providing a supply of blast air and pot air, wherein the blast air is communicated along a blast air supply line and pot air is communicated along a pot air supply line; a blast pot is configured to receive abrasive media and pot air and release abrasive media at a discharge into a media conduit which communicates the abrasive media to a mixing device; an air pressure amplifier disposed on the pot air supply line, is adapted to selectively increase the air pressure of the pot air creating a pot air head over-pressure within the blast pot, wherein the pressure of the pot air head, minus the pressure of the blast air, is the over-pressure which is positive; wherein the blast air and the abrasive media are mixed together in the mixing device to form a blast air media mixture which is communicated to a nozzle and discharged from the nozzle as a blast spray.

The wet and dry abrasive media blasting system further comprises a metering valve, disposed on the media conduit, downstream of the discharge, and up stream of the mixing device, the metering valve selectively controls the flow of abrasive media and therefor the amount of abrasive media communicated to the mixing device.

The wet and dry abrasive media blasting system wherein the metering valve is disposed at an elevation above the discharge.

The wet and dry abrasive media blasting system wherein the metering valve is disposed at an elevation greater than ten inches above the discharge.

The wet and dry abrasive media blasting system further comprising a pressure regulator disposed on the blast air supply line to selectively control the air pressure of the blast air thereby ensuring a consistent over-pressure.

The wet and dry abrasive media blasting system further comprising a pressure regulator, disposed upstream of the air pressure amplifier on the pot air supply line, to selectively control the air pressure of the pot air introduced into the air pressure amplifier.

The wet and dry abrasive media blasting system wherein the over-pressure is between 1% and 200% of the blast air pressure.

The wet and dry abrasive media blasting system wherein the over-pressure is between 5% and 100% of the blast air pressure.

The wet and dry abrasive media blasting system wherein the over-pressure is between 10% and 50% of the blast air pressure.

The wet and dry abrasive media blasting system wherein the pressure amplifier is an air driven air pressure amplifier.

The wet and dry abrasive media blasting system wherein the abrasive media is selected from the following, a wet media, and a dry media.

The wet and dry abrasive media blasting system wherein the mixing device is a T connection.

The wet and dry abrasive media blasting system wherein the compressed air supply is a single air compressor supplying compressed air to the blast air supply line and to the pot air supply line.

The wet and dry abrasive media blasting system wherein the compressed air supply includes two air compressors, one for supplying compressed air to the blast air supply line and a second for supplying compressed air to the pot air supply line.

A wet and dry abrasive media blasting system of the type including;

a source of compressed air providing a supply of blast air and of pot air, a blast pot pressure vessel for containing pot air as a pot air head and abrasive media, a conduit that connects a discharge of the blast pot to a mixing device in which the abrasive media is mixed with the blast air to form a blast air/media mixture which can be released through a nozzle, the system comprising; an air pressure amplifier disposed on a pot air supply line configured to selectively increase the air pressure of the pot air head, such that the pressure of the pot air head is selectively greater than the pressure of the blast air and is an over-pressure.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
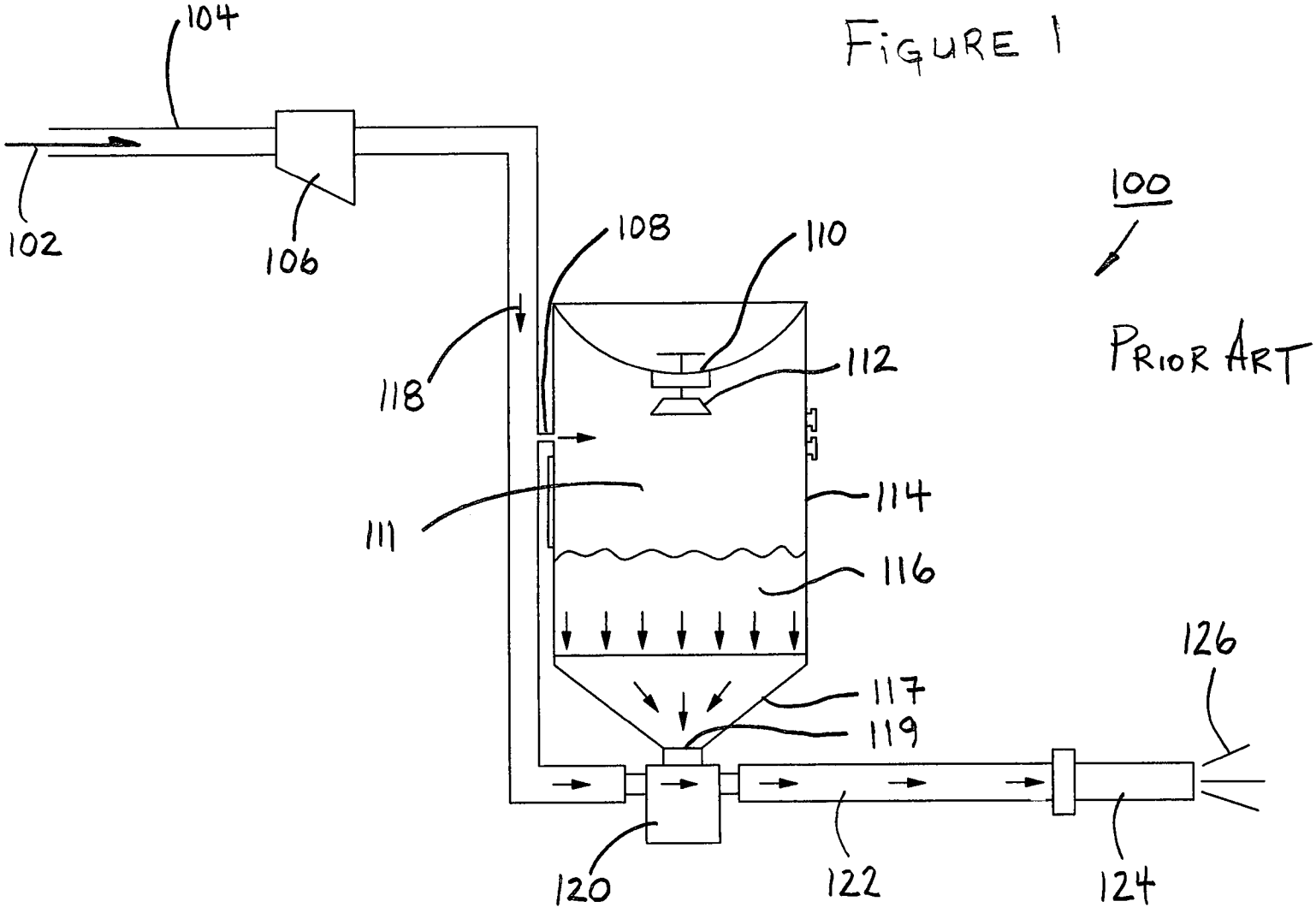
FIG. 1 is a schematic of a prior art dry abrasive media blasting system.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

The reader will note that "abrasive media" 323 also referred to as simply "media" refers to an abrasive substance which encompasses both wet media 324 and dry media 325. Dry media 325 may be for example be sand, corundum, garnet, alumina or any other known abrasive granular materials. Wet media 324 may for example be a slurry of water or another liquid, and any of the known available abrasive dry media materials.

The reader will also note that the term over-pressure herein is defined as the pressure of the pot air head 322, minus the pressure of the blast air 304. For satisfactory operation the over-pressure is positive. Pot air head 322 is pot air within the upper portion 321 or head portion of the blast pot 326.

FIG. 1 is a schematic of a prior art dry abrasive media blasting system. Dry abrasive blast system 100 includes the following major components; namely incoming compressed air 102, which flows along inlet conduit 104 wherein the pressure of the incoming air is regulated with air regulator and valve 106. Regulated air 118 flows into blast pot 114 through pot air inlet 108. Dry abrasive blast media 116 which can for example be sand, silica, garnet, and alumina is added to blast pot 114 through media fill opening 110 and is closed off with fill valve 112 which typically is a pop up style valve providing an air tight seal. Blast pot 114 is an air tight pressure vessel which is capable of containing compressed air, water, dry abrasive blast media and wet abrasive blast media. Dry abrasive blast media 116 flows downwardly under gravity within blast pot 114 and into conical section 117 an out discharge 119. Pot air 111 replaces the volume occupied by dry abrasive blast media 116 as it is discharged from blast pot 114. Pot outlet metering valve 120 controls the amount of dry abrasive blast media 116 discharged into outlet conduit 122. The dry abrasive blast media 116 is entrained in the regulated air 118 and is carried along outlet conduit 122 and the mixture is discharged out of the end of nozzle 124 as blast spray 124.

This type of system typically is limited to an abrasive media size of no smaller than 40-80 mesh. The dry abrasive blast media 116 must flow downwardly in blast pot 114 in a predictable manner to provide a controllable system. It is observed that using dry abrasive blast media 116 finer than 40-80 mesh produces clumping and non-uniform flow of abrasive media in the blast pot 114 which results in an uncontrollable flow of abrasive media.

Figure 2:
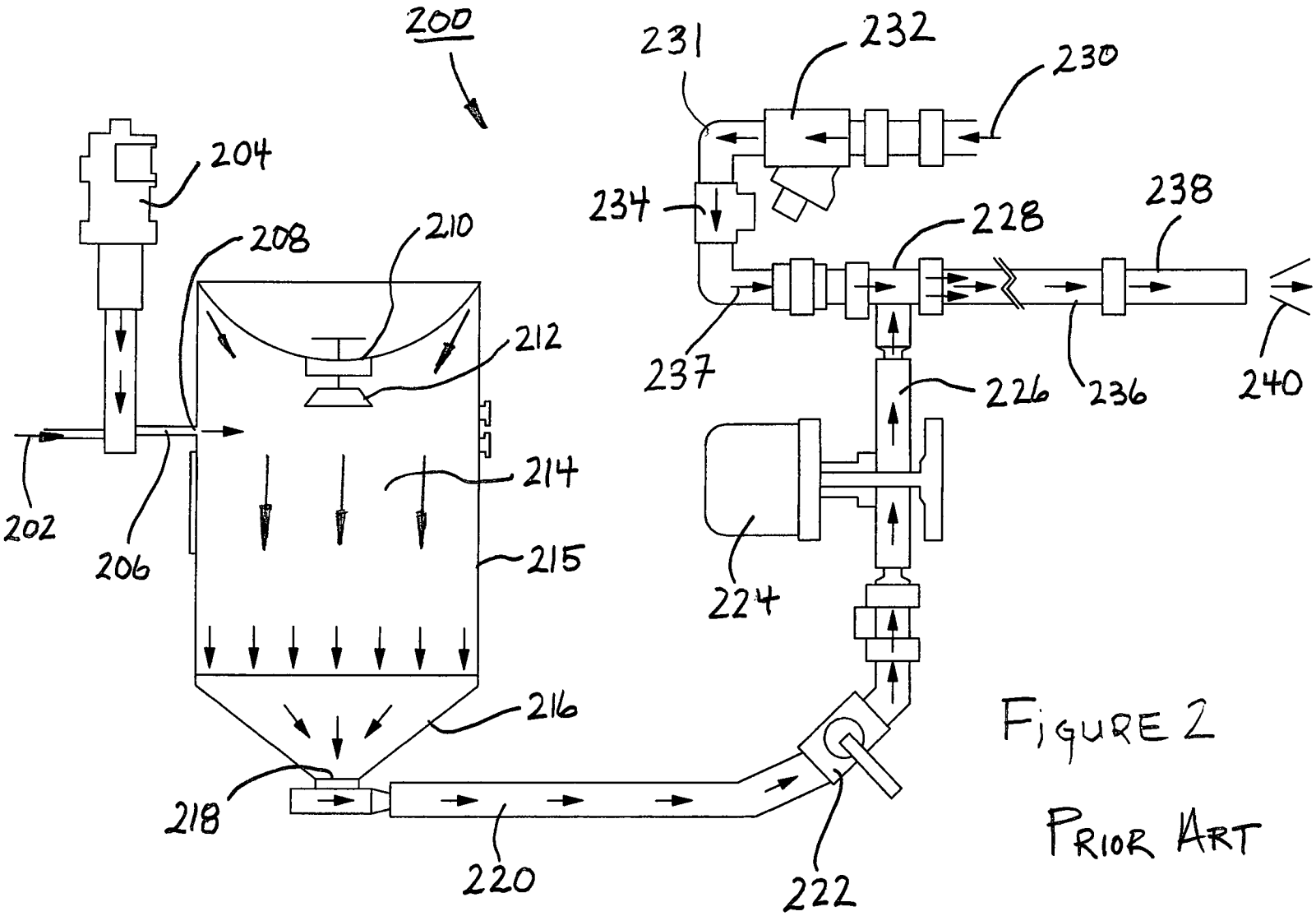
FIGURE 2 PRIOR ART
FIG. 2 is a schematic of a prior art wet abrasive media blasting system.

FIG. 2 is a schematic of a prior art wet abrasive media blasting system. Wet abrasive blast system 200 includes the following major components namely incoming water supply 202, which flows into water pump 204 and exits as pressure regulated water 206 and enters blast pot 215 at pot water inlet 208. Wet abrasive blast media which can for example be sand, silica, garnet, and alumina is added to blast pot 215 through media fill opening 210 which is closed off with fill valve 212 which typically is a pop up style valve providing an air tight seal. Wet abrasive blast media is mixed with the water in blast pot 215 producing an abrasive slurry which flows downwardly in blast pot 215 under pressure from the pressure regulated water 206 down conical section 216 and out through discharge 218 into outlet conduit 220. On-off valve 222 can manually stop the supply of abrasive slurry 214. Abrasive slurry 214 also passes through remotely controlled on-off pinch valve 224 which allows the flow of abrasive slurry 214 through a flexible conduit 226 to mixing device 228 where abrasive slurry 214 is mixed with compressed air 230.

Compressed air 230 flows through air conduit 231 which includes an on-off air valve 232 and a check valve 234 to prevent flow of slurry further into air conduit 231. Compressed air 230 mixes with abrasive slurry 214 at mixing device 228 where water, abrasive media, and compressed air mix together and flow through blast hose 236 an nozzle 238 where the mixture is discharged as blast spray 240.

The blast pot 215 is bled of all air since entrapped compressible air in blast pot 215 causes well known uncontrollable and unwanted pressure fluctuations that effect the consistency and safety of the blasting operation. The water abrasive slurry 214 is inserted into air stream 237 creating a mixture of compressed air with entrained abrasive media and water. The abrasive slurry 214 expended in blast pot 215 is replaced with pressure regulated water 206 which is pumped into the blast pot 215 under a controlled pressure which in turn controls the amount of abrasive slurry 214 inserted into air stream 237.

In practice pressure regulated water 206 is typically regulated to be higher than the pressure of compressed air 230 flowing in air stream 237. This higher pressure moves abrasive slurry 214 freely out of blast pot 114 and ensures entrainment of abrasive slurry 214 into the air stream 237 at the mixing device 228.

Figure 3:
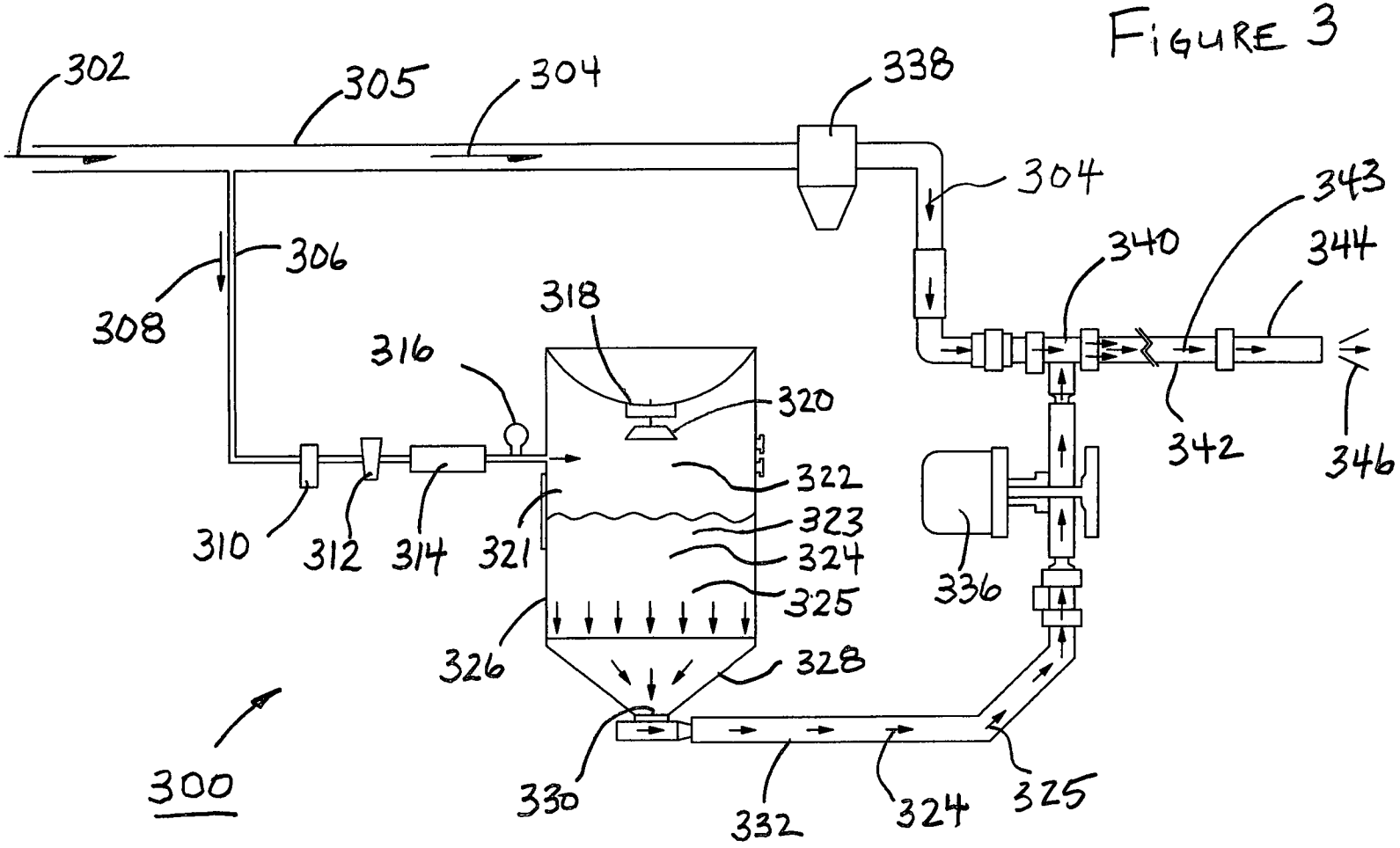
FIG. 3 is a schematic of a currently developed wet and dry abrasive media blasting system.

FIG. 3 is a schematic of an example of the current wet and dry abrasive media blasting system which is a system capable of both wet and dry abrasive media blasting. Wet and dry abrasive media blasting system 300 includes the following major components namely incoming compressed air supply 302, which bifurcates into two branches the first along pot air supply line 306 for supplying pot air 308 and second along blast air supply line 305 for supplying blast air 304. Blast pot 326 is an air tight pressure vessel which is capable of containing compressed air, water, abrasive media including dry abrasive blast media and wet abrasive blast media.

Pot air 308 flows through air filter 310, a pressure regulator 312 and through an air pressure amplifier 314 before entering blast pot 326. Preferably a pressure gauge 316 indicates the inlet air pressure into blast pot 326. In practice pot air 308 forms a pot air head 322 above abrasive media 323. The pressure of pot air head 322 is higher than blast air 304 pressure in order to ensure smooth delivery of the abrasive media 323 out of discharge 330. The air pressure amplifier 314 disposed on the pot air supply line 306, is adapted to selectively increase the air pressure of the pot air 308 creating a pot air head 322 over-pressure within blast pot 326. Over-pressure is the pressure of pot air head 322, minus the pressure of the blast air 304 and is always positive. The over-pressure may be from 1 to 200% of the blast air pressure, more preferably from 5% to 100% of blast air pressure and more preferably from 10% to 50% of blast air pressure.

Pot air head 322 is usually a distinct phase above the abrasive media 323. Pot air head 322 is mainly compressed pot air 308 regardless of the type of abrasive media 323 such as wet media 324 or dry media 325. This creates an extremely flexible system capable of using wet or dry abrasive media with surprisingly improved abrasive flow control.

Improved control of the flow of the abrasive media, also termed flow control, is the result of using an air pressure amplifier 314 which creates a pot air head 322 with a controllable over-pressure. Further improvements in flow control are observed with the additional use of metering valve 336 and the optimized positioning of the metering valve 336. Further improvements in flow control are observed by using a blast air 304 pressure regulator 338 which further ensures a consistent over-pressure.

Many types of air pressure amplifiers are available and could work however air pressure amplifier 314 is preferably powered by the air it amplifies and can be selected to provide a wide range of pressures. This type of air pressure amplifier 314 is referred to as an air driven air pressure amplifier.

Blast pot 326 includes a media fill opening 318 and a fill valve 320 to load the blast pot with the selected abrasive media 323 which in the case of wet blasting usually includes abrasive and water namely wet media 324, and in the case of dry blasting includes only dry abrasive media namely dry media 325. The abrasive media 323 flows down the conical section 328 of blast pot 326 and out though discharge 330 and into media conduit 332. A metering valve 336 can be used to increase the control of the flow of the abrasive. Preferably the metering valve 336 includes an on/off function for completely cutting off the flow through the media conduit 332.

Blast air 304 flows through a pressure regulator 338 which can be used to selectively control the blast air pressure. Pressure regulator 338 helps maintain a uniform and consistent over-pressure. Preferably pressure regulator 338 includes an on/off function to completely shut off the flow of blast air 304. Wet media 324 or dry media 325 mixes with blast air 304 at mixing device 340 which forms blast air/media mixture 343 which then flows through blast line 342, and out through nozzle 344 as a blast spray 346. Mixing device 340 works well as a simple T connection, but it may also be a Y connection or it may be any other mixing device known in the industry.

The reader will note that when using the system for dry abrasive media blasting or for wet abrasive media blasting the upper portion 321 of blast pot 326 contains primarily pot air 308 which forms a pot air head 322. Operating the system in a wet mode is with pot air head 322 over wet media 324 which preferably is a mixture of water and an abrasive media also referred to as an abrasive slurry. Operating the system in a dry mode is with pot air head 322 over dry media 325 which preferably is a dry abrasive blast media.

In regard to operating the wet and dry abrasive media blasting system 300 in the wet mode the air pressure amplifier 314 ensures that pot air head 322 pressure is always higher than blast air 304 pressure. This is referred to as air over-pressure which is not found in prior art wet systems. Prior art wet systems use water pressure only in the blast pot and go to lengths to eliminate any air in the blast pot 326. In the current system the amount of air over-pressure also allows one to control the rate at which wet media 324 is discharged from blast pot 326. Additionally wet and dry abrasive media blasting system 300 includes a abrasive media metering valve 336 which also helps control pressure fluctuations within blast pot 326 and provide enhanced control of the flow rate of wet media 324 to mixing device 340. The inventor has surprisingly found that the use of an air pressure amplifier 314 together with an abrasive media metering valve 336 results in a stable and controllable delivery of wet media 324 to the mixing device 340 which provides a stable, controllable and uniform blast spray 346.

In regard to operating the wet and dry abrasive media blasting system 300 in the dry mode the air pressure amplifier 314 ensures that pot air pressure is always higher than blast air pressure. This is referred to as air over-pressure which is not a feature in prior art dry blasting systems. Prior art dry blasting systems rely on gravity feed to move the dry blast media downwardly toward discharge 330. In gravity fed dry systems abrasives finer than 40 to 80 mesh tend to clump and clog within blast pot 326 and media conduit 332 which limits the use of such systems. In the presently described dry mode, the air over-pressure allows one to control the flow of dry abrasive media 325 through the blast pot 326 and media conduit 332. Metering valve 336 provides additional control such that a user can more easily obtain stable and uniform flow of dry media 325 to mixing device 340 and ultimately of blast spray 346. The metering valve 336 is disposed on the media conduit 332 downstream of the discharge 330 and up stream of the mixing device 340. In the present system much finer abrasives (up to 800 mesh) can be used without control issues.

In practice it has been determined surprisingly that placing the metering valve 336 at an elevation above discharge 330 results in even better control over the flow of abrasive media 323 through media conduit 332 and ultimately of control of the blast spray 346. Metering valve 336 is depicted at an elevation above discharge in FIG. 3. Preferably metering valve 336 is disposed at an elevation greater than 10" (ten inches) above discharge 330 and more preferably 20" (twenty inches) to 40" (40 inches) above discharge 330.

What is claimed is:

1. A wet and dry abrasive media blasting system comprises:

a compressed air supply providing a supply of blast air and pot air, wherein the blast air is communicated along a blast air supply line and pot air is communicated along a pot air supply line;

a blast pot is configured to receive abrasive media and pot air and release abrasive media at a discharge into a media conduit which communicates the abrasive media to a mixing device;

an air pressure amplifier disposed on the pot air supply line is adapted to selectively increase the air pressure of the pot air, the increase in the air pressure of the pot air is an over-pressure relative to the blast air pressure;

wherein the blast air and the abrasive media are mixed together in the mixing device to form a blast air media mixture which is communicated to a nozzle and discharged from the nozzle as a blast spray.

2. The wet and dry abrasive media blasting system according to claim 1 further comprises a metering valve, disposed on the media conduit, downstream of the discharge, and up stream of the mixing device, the metering valve selectively controls the flow of abrasive media and therefor the amount of abrasive media communicated to the mixing device.

3. The wet and dry abrasive media blasting system according to claim 2 wherein the metering valve is disposed at an elevation above the discharge.

4. The wet and dry abrasive media blasting system according to claim 2 wherein the metering valve is disposed at an elevation greater than ten inches above the discharge.

5. The wet and dry abrasive media blasting system according to claim 2 wherein the metering valve includes an on/off function for completely cutting off the flow of abrasive media through the media conduit.

6. The wet and dry abrasive media blasting system according to claim 1 further comprising a pressure regulator disposed on the blast air supply line to selectively control the air pressure of the blast air thereby ensuring a consistent over-pressure.

7. The wet and dry abrasive media blasting system according to claim 5 wherein the pressure regulator includes an on/off function for completely cutting off the flow of blast air through the blast air supply line.

8. The wet and dry abrasive media blasting system according to claim 2 further comprising a pressure regulator, disposed upstream of the air pressure amplifier on the pot air supply line, to selectively control the air pressure of the pot air introduced into the air pressure amplifier.

9. The wet and dry abrasive media blasting system according to claim 1 wherein the over-pressure is between 1% and 200% of the blast air pressure.

10. The wet and dry abrasive media blasting system according to claim 1 wherein the over-pressure is between 5% and 100% of the blast air pressure.

11. The wet and dry abrasive media blasting system according to claim 1 wherein the over-pressure is between 10% and 50% of the blast air pressure.

12. The wet and dry abrasive media blasting system according to claim 1 wherein the pressure amplifier is an air driven air pressure amplifier.

13. The wet and dry abrasive media blasting system according to claim 1 further includes abrasive media selected from the following, wet abrasive media, and a dry abrasive media.

14. The wet and dry abrasive media blasting system according to claim 1 wherein the mixing device is a T connection.

15. The wet and dry abrasive media blasting system according to claim 1 wherein the mixing device is a Y connection.

16. The wet and dry abrasive media blasting system according to claim 1 wherein the compressed air supply is a single air compressor supplying compressed air to the blast air supply line and to the pot air supply line.

17. The wet and dry abrasive media blasting system according to claim 1 wherein the compressed air supply includes two air compressors, one for supplying compressed air to the blast air supply line and a second for supplying compressed air to the pot air supply line.

18. A wet and dry abrasive media blasting system of the type including:

a source of compressed air providing a supply of blast air and of pot air, a blast pot pressure vessel for containing pot air as a pot air head and abrasive media, a conduit that connects a discharge of the blast pot to a mixing device in which the abrasive media is mixed with the blast air to form a blast air/media mixture which can be released through a nozzle, an air pressure amplifier disposed on a pot air supply line configured to selectively increase the air pressure of the pot air head, such that the pressure of the pot air head is selectively greater than the pressure of the blast air and is an over-pressure.

* * * * *